US009646587B1

(12) United States Patent
Becker et al.

(10) Patent No.: US 9,646,587 B1
(45) Date of Patent: May 9, 2017

(54) RHYTHM-BASED MUSICAL GAME FOR GENERATIVE GROUP COMPOSITION

(71) Applicant: DISNEY ENTERPRISES, INC., Burbank, CA (US)

(72) Inventors: Jonathan Michael Becker, North Hollywood, CA (US); James R. Robertson, Los Angeles, CA (US); Dolce Lin Wang, Santa Monica, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 15/064,788

(22) Filed: Mar. 9, 2016

(51) Int. Cl.

| | |
|---|---|
| ***G10H 1/36*** | (2006.01) |
| ***G10H 1/00*** | (2006.01) |
| ***G10H 1/40*** | (2006.01) |
| ***G10H 1/46*** | (2006.01) |

(52) U.S. Cl.
CPC ..... *G10H 1/0025* (2013.01); *G10H 1/0066* (2013.01); *G10H 1/361* (2013.01); *G10H 1/40* (2013.01); *G10H 1/46* (2013.01); *G10H 2210/026* (2013.01); *G10H 2210/391* (2013.01); *G10H 2220/145* (2013.01); *G10H 2220/275* (2013.01); *G10H 2240/325* (2013.01)

(58) Field of Classification Search
CPC . G10H 1/361; G10H 1/0066; G10H 2240/325
USPC ..... 84/634
See application file for complete search history.

(56) References Cited

U.S. PATENT DOCUMENTS

| | | | | |
|---|---|---|---|---|
| 5,719,344 | A * | 2/1998 | Pawate | G10H 1/361 434/307 A |
| 5,913,259 | A * | 6/1999 | Grubb | G10H 1/36 84/610 |
| 6,107,559 | A * | 8/2000 | Weinstock | G10G 3/04 84/470 R |
| 6,353,174 | B1 * | 3/2002 | Schmidt | G10H 1/0058 709/200 |
| 6,653,545 | B2 * | 11/2003 | Redmann | G10H 1/0058 84/609 |
| 6,969,795 | B2 * | 11/2005 | Hofmeister | G10H 1/0556 84/600 |

(Continued)

*Primary Examiner* — David Warren
(74) *Attorney, Agent, or Firm* — Marsh Fischmann & Breyfogle LLP; Kent A. Lembke

(57) ABSTRACT

A musical game system and associated methods configured to allow for unguided, free-form group-based musical expressivity during generation of a collaborative digital music track (or "song"). The musical game system is designed to provide a hardware and software pipeline that functions to record, quantize, and loop multiple (e.g., 1 to 15 or more) users' inputs (e.g., via a piezoelectric MIDI (Musical Instrument Digital Interface) controllers or triggered instruments or other user input devices) in a dynamic playback space. The musical game system further functions to provide volume attenuation and localization of playback to enable participants to express themselves with their user inputs with complete agency while simultaneously adding to an overarching, collaborative musical composition generated using their user inputs and other participants' user inputs. The collaborative musical composition is created by the system so as to maintain coherence and tonality regardless of the user inputs the system receives and processes.

16 Claims, 4 Drawing Sheets

(56) References Cited

U.S. PATENT DOCUMENTS 7,012,182 B2 * 3/2006 Nishitani ..... G10H 1/00 84/477 R
7,193,148 B2 * 3/2007 Cremer ..... G10H 1/40 84/609
7,435,894 B2 * 10/2008 Veno ..... A63B 43/00 84/615
7,714,222 B2 * 5/2010 Taub ..... G10H 1/0058 84/600
7,781,663 B2 * 8/2010 Totaka ..... G10H 1/40 84/612
7,853,342 B2 * 12/2010 Redmann ..... G10H 1/0058 700/94
8,035,020 B2 * 10/2011 Taub ..... G10H 1/0058 84/600
8,178,773 B2 * 5/2012 Riopelle ..... G10H 1/0025 84/723
8,301,076 B2 * 10/2012 Grandinetti ..... G10H 1/0083 381/119
8,678,896 B2 * 3/2014 Pitsch ..... A63F 13/12 463/35
8,704,073 B2 * 4/2014 Georges ..... G10H 1/0025 84/477 R
8,777,747 B2 * 7/2014 McCauley ..... A63F 13/06 463/37
8,782,418 B2 * 7/2014 Poitier ..... G11B 20/00086 713/176
9,132,348 B2 * 9/2015 Parks ..... G10H 1/368
9,412,351 B2 * 8/2016 Sapp ..... G10H 1/28
9,452,358 B2 * 9/2016 McCauley ..... A63F 13/06
2002/0088337 A1 * 7/2002 Devecka ..... A63F 13/005 84/743
2003/0164084 A1 * 9/2003 Redmann ..... G10H 1/0058 84/615
2004/0176025 A1 * 9/2004 Holm ..... G10H 1/0066 455/3.06
2005/0098021 A1 * 5/2005 Hofmeister ..... G10H 1/0556 84/453
2006/0123976 A1 * 6/2006 Both ..... G10H 1/0058 84/600
2006/0144212 A1 * 7/2006 Hofmeister ..... G10H 1/0083 84/724
2007/0140510 A1 * 6/2007 Redmann ..... G10H 1/0058 381/97
2007/0214939 A1 * 9/2007 Veno ..... A63B 43/00 84/600
2007/0234882 A1 * 10/2007 Usa ..... G10H 1/0008 84/612
2008/0060506 A1 * 3/2008 Laycock ..... G09B 5/12 84/645
2008/0140238 A1 * 6/2008 Rurup ..... G10H 1/0058 700/94
2008/0190271 A1 * 8/2008 Taub ..... G10H 1/0058 84/645
2008/0212617 A1 * 9/2008 Flesch ..... G10H 1/0058 370/503
2009/0131170 A1 * 5/2009 Yow ..... A63F 13/00 463/37
2009/0199698 A1 * 8/2009 Totaka ..... G10H 1/40 84/611
2009/0258700 A1 * 10/2009 Bright ..... A63F 13/10 463/31
2010/0132536 A1 * 6/2010 O'Dwyer ..... G10H 1/0008 84/609
2010/0146283 A1 * 6/2010 Poitier ..... G11B 20/00086 713/176
2010/0212478 A1 * 8/2010 Taub ..... G10H 1/0058 84/645
2010/0326256 A1 * 12/2010 Emmerson ..... G10H 1/0025 84/610
2011/0021273 A1 * 1/2011 Buckley ..... A63F 13/00 463/31
2011/0283362 A1 * 11/2011 Horneff ..... H04H 20/38 726/26
2013/0039496 A1 * 2/2013 Grandinetti ..... G10H 1/0083 381/17
2013/0151556 A1 * 6/2013 Watanabe ..... G06F 17/30755 707/769
2013/0238999 A1 * 9/2013 Helms ..... G06F 3/165 715/727
2015/0221297 A1 * 8/2015 Buskies ..... G10H 1/40 84/611
2016/0062990 A1 * 3/2016 Lee ..... G06F 17/289 704/2
2016/0085846 A1 * 3/2016 Smith ..... G06Q 10/10 705/12
2016/0093277 A1 * 3/2016 Sapp ..... G10H 1/28 84/645
2016/0253915 A1 * 9/2016 Lee ..... G09B 15/00
2016/0307551 A1 * 10/2016 Chan ..... G06F 3/165
2016/0343362 A1 * 11/2016 Brosius ..... G10H 1/0016
2016/0357251 A1 * 12/2016 O'Neil ..... G06F 3/011

* cited by examiner

RHYTHM-BASED MUSICAL GAME FOR GENERATIVE GROUP COMPOSITION

BACKGROUND

1. Field of the Description

The present description relates, in general, to software and hardware systems supporting digital musical composition and playback, and, more particularly, to a system (and corresponding gaming or musical composition methods) for providing a rhythm-based musical game for enjoyment by a group of one-to-many (e.g., 1 to 15 or more) participants. The system is adapted to facilitate the group to interact in a collaborative manner to create a digital track or musical composition even though the participants may be strangers with limited or even no musical training.

2. Relevant Background

There are numerous settings where music is played to enhance the experience of visitors. More recently, there has a been a growing demand for the visitors of facilities such as musical museums or displays, malls, and amusement parks to be able to immerse themselves in an experience and to interact with the other visitors to create a more enjoyable experience, and there have been many calls for this immersive and/or interactive experience to include creating or modifying the music being played in a real time and interactive way.

As a specific example, amusement and theme park operators often define their parks and areas within their parks by groups of characters and the worlds or lands that these characters exist within or call home. Visitors to the parks find the "worlds" or "lands" defined by many things with music being one of the most important. Historically, though, music in amusement and theme parks has been a mostly passive experience in the sense that it was something the visitors simply received or perceived and not something that the visitors interacted with or created except in some more rare cases where a character or show cast member facilitated their participation (e.g., provided guidance or directed the visitors' collaboration).

There are a number of challenges or problems in creating an interactive and collaborative music experience for use in amusement or theme parks and other facilities open to many visitors. One major obstacle is that music creation generally requires that the participant have prior training such as in playing a particular musical instrument. Another obstacle is how to achieve effective collaboration with other participants in the interactive music experience. These two obstacles have proven very difficult to overcome as it is undesirable to block untrained or unskilled people from participating (e.g., want to have the experience open to all visitors of a park) and want the music experience to be autonomous or self-directed by the participants (e.g., do not want to have to guide the participants with a human director).

Previously, interactive music experiences have been provided by systems, such as video game systems in which the players "play" a guitar or drums, which rely on visual techniques to create the experience. For example, the game or music experience system may include touch-sensitive game controls or tabletop displays and/or gestural recognition systems to identify user inputs and use visual graphics provided on a game monitor (e.g., a television or computer screen) to instruct participants in how to engage the system including when and which notes to play or input. This arrangement may be useful in some settings, but there are many settings including areas within a theme or amusement park where it is more desirable to allow the participants to have more agency and for the game or music system to run autonomously.

Stated differently, it is desirable for the collaborative music to be created without a human leader or director and with each participant having the perception that they are free to provide input without visual graphics prompting or fully choreographing their actions. However, it is also desirable for a game to be open to and fun for a group of participants and not just limited to one or two players. Further, it is desirable for the game or music system to be configured to help the group actually create "music" that is enjoyable to listen to by the participants and also to observers and not just create a cacophony of noises or chaotic sounds, and this is true even when the participants may not have met prior to the gaming experience.

SUMMARY

The inventors recognized that for amusement and theme park and other facility operators that it is often desirable or even central to development of these facilities to provide increased immersion and interactivity for visitors. Music generation was identified as one way to allow the visitors (or "participants") to feel immersed in an experience and to interact with each other in a collaborative manner to create a desirable product in the form of a musical composition or digital music track that they and nearby observers would enjoy hearing.

With this goal in mind, the inventors understood that they would have to solve the problem of facilitating coherent music composition with random and possibly unrelated groups of people or participants without verbal communication or human instruction and with the understanding that many of the participants would have little or no musical training. The musical game system (or music generation and playback system) and associated methods described herein are configured to allow for unguided, free-form group-based musical expressivity during generation of a collaborative digital music track (or "song").

From a high-level perspective, the musical game system is designed to provide a hardware and software pipeline that functions to record, quantize, and loop multiple (e.g., 1 to 15 or more) users' inputs (e.g., via a piezoelectric MIDI (Musical Instrument Digital Interface) controllers or triggered instruments or other user input devices) in a sonically dynamic playback space. The musical game system further functions to provide volume attenuation and localization of playback to enable participants to express themselves with complete agency while simultaneously adding to an overarching, collaborative musical composition (e.g., the digital music track being created and used for playback over the system's speaker or playback assembly) generated using their own input as well as other participants' user inputs. The collaborative musical composition is created by the system so as to maintain coherence and tonality regardless of the user inputs the system receives and processes.

Through this musical game system, the participant can both play (e.g., bang on a drum, play a keyboard, sing, dance, or provide other user "inputs") as they desire, regardless of tempo or key (e.g., in or out of time or whether they are in or out of key), yet also generate musical passages that synchronize with all other user-generated material (mix of sets of other user-generated musical passages). This allows a group of random people to simultaneously play music within the same physical space without conflict or a need for synchronization as would be the case for a band or orchestra.

The combination of user inputs and the output or playback by the musical game system provides a cohesive, engaging musical experience for both participating and non-participating visitors to the physical space (e.g., a game area of a land/world at a theme park or the like). The musical game system works without a need for any verbal or graphical instruction and allows for an infinite variety of unrestrained participatory actions of musically trained or untrained participants, which opens up a new form of collaborative expression that is useful in a wide variety of facilities to enhance visitors' experiences.

More particularly, a method is taught for providing an interactive music game. The method includes first operating an audio output assembly to output sound associated with a background rhythm track defining timing of notes for a group collaborative composition. The method also includes, during the first operating, sensing a plurality of interactions with a plurality of user input devices. The music game method then includes, in response to the sensing, generating a note trigger signal for each of the user input devices. With a processor running a music composition and playback module, the method involves processing each of the note trigger signals to select a playback sound and to determine, in relation to the background rhythm track, whether the note trigger signals are synchronized with the timing of the notes or unsynchronized with the timing of the notes. Significantly, the method also includes quantizing the unsynchronized note trigger signals using the timing of the notes to time align the unsynchronized note trigger signals with the background rhythm track. Then, with the music composition and playback module, the method includes second operating the audio output assembly to play the group collaborative composition via the audio output assembly including outputting the playback sounds for the synchronized note trigger signals and outputting the playback sounds for the time aligned note trigger signals.

In some implementations of the method, the audio output assembly includes a speaker local to each of the user input devices, and the step of playing of the group collaborative composition comprises playing the playback sounds associated with each of the note trigger signals at one of the speakers local to the user input device associated with the generating of the note trigger signal. In such implementations, the audio output assembly includes a plurality of global speakers operated during the playing of the group collaborative composition to play all of the playback sounds. Further, the step of playing the group collaborative composition includes dynamically adjusting volume levels of the speakers local to the user input devices based on a number of the user input devices being concurrently operated with the plurality of the interactions.

In some embodiments, the method further includes selecting additive melodic tracks based on a number of or locations of the user input devices operated by the plurality of the interactions. Then, the step of playing of the group collaborative composition includes playing the additive melodic tracks with the playback sounds and synchronized with the timing of the notes. In the same or other embodiments, the user input devices each comprises at least one contact surface and a piezoelectric MIDI trigger associated with the contact surface for generating the note trigger signal. The quantizing may be performed in a number of ways and may include aligning timing of playback of each of the unsynchronized note trigger signals with one of the notes of the group collaborative composition whose timing is set by the background rhythm track being played over the audio output assembly (e.g., as a metronome-like repeating sound (e.g., a bass drum beat, a bass guitar note, and so on)).

DETAILED DESCRIPTION OF THE PREFERRED EMBODIMENTS

Briefly, a rhythm-based musical game system (and associated method(s)) is described that facilitates interaction and collaboration among a group of one-to-many (e.g., up to 15 or more) participants to generate a collaborative musical track or digital composition. The generated musical track/composition is played back with a speaker assembly including speakers local to each user input device (or to each participant) and global speakers to the group and observers/non-participants in the physical space/area in which the system is provided. To explain the musical game system, it may be useful to first describe a particular implementation to describe useful components of a system and their operation (e.g., method implemented with the system) and then proceed with more general descriptions of the concepts of a musical game system.

Figure 1:
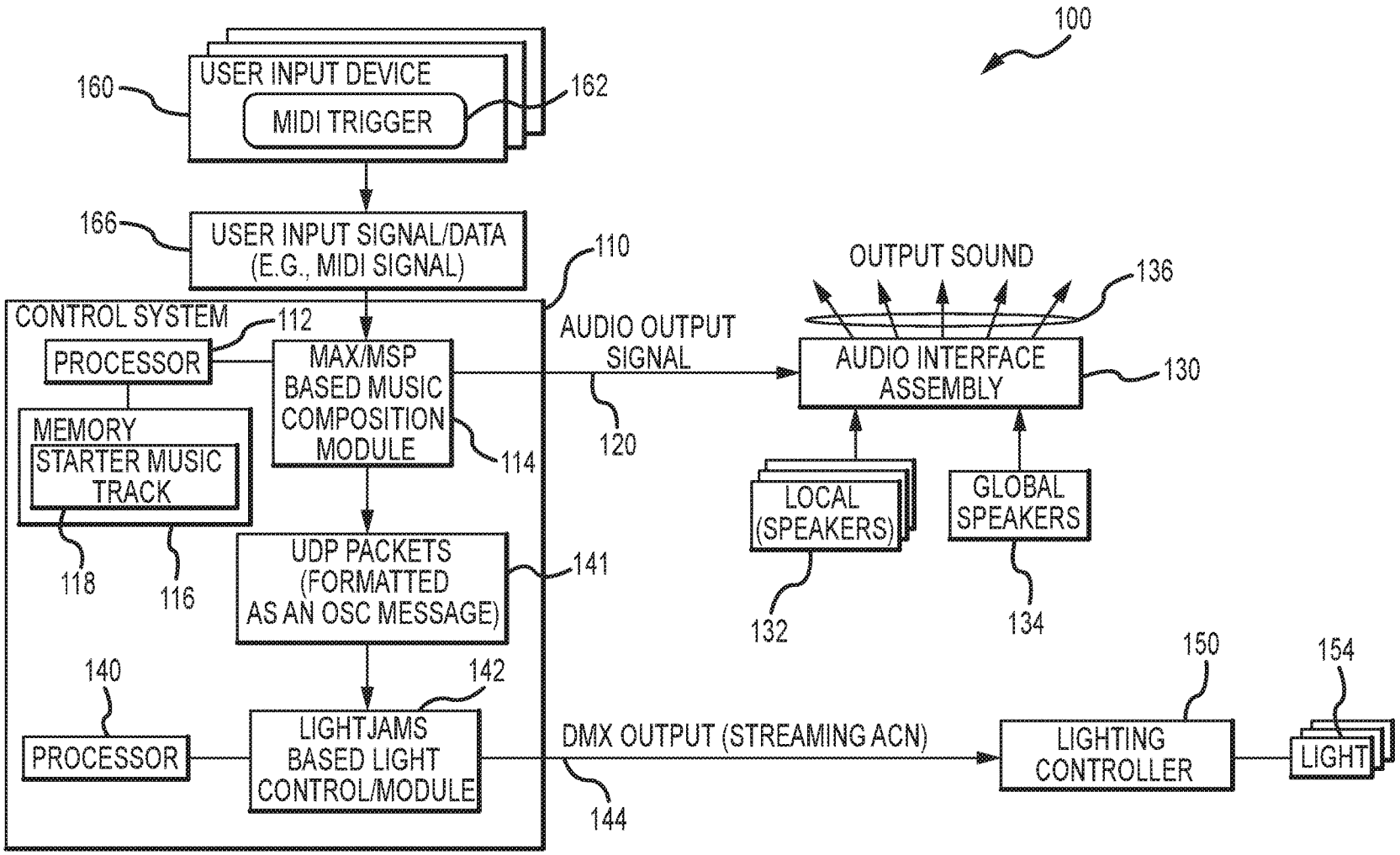
FIG. 1 is a functional block diagram of an exemplary rhythm-based musical game system of the present description.

A prototype musical game system was designed and fabricated to provide a drum circle experience, and, to this end, the game system provided user input devices in the form of drum sets with each "drum" having a body and an upper contact surface that was configured as a piezoelectric MIDI trigger. FIG. 1 illustrates a functional block diagram of the musical game system 100 that is useful for showing how data flows through the control system 110 when operated or played by a group of participants. As shown, the system 100 includes the control system 110 which may take the form or one or more computers or computing devices for processing user inputs (shown as user input signals/data 166) and for generating control signals for operating an audio assembly (or audio interface assembly) 136 and, optionally, a lighting controller 150 to selectively operate lights 154 in the same space as a set of user input devices 160.

The control system includes a processor 112 running or executing code/instructions (e.g., a software program in memory 116) to provide a music composition module 114. The processor 112 also manages memory 116, which is used to store one or more starter music tracks (or rhythm-providing metronome track), and the music composition module 114 plays (as shown by output sound 136) the starter track over local speakers 132 (one or more speakers near each user input device 160) and global speakers 134 (used to play music throughout the game space containing the system 100) via an audio output signal 120 to the audio assembly 130. The control system 110 also includes a second processor 140 running or executing code/instructions to provide a light control module 142, and the music composition module 114 functions to generate data/control signals (e.g., UDP (User Datagram Protocol) packets that may be formatted as an OSC (Open Sound Control) message) 141 that are communicated to the light control module 142, which in turn generates control signals (e.g., DMX output signals that may be formatted as Streaming ACN (Architecture for Control Networks) (or sACN) 144 for communication with and operating lights 154 in the game space via lighting controller 150.

The musical game system 100 includes a plurality (e.g., one to 15 or more) user input devices 160 that allow a user or participant (or person playing the musical composition game provided by system 100) to provide inputs to interact with the system 100 and help to create a collaborative music composition with other participants that are operating other user devices 160. In the prototype, the user input devices 160 were configured as drums or drum sets with one or more drums that can be tapped or pounded with the participants hand to cause a user input signal/data 166 to be transmitted to the control system 110 for processing by the music composition module 114. Particularly, each drum/user input device 160 included an MIDI trigger that sensed tapping/contact with an outer drum skin/surface of the user input device 160 and responded by generating and transmitting a MIDI signal 166 to the control system 110 for use by the music composition module 114.

One design purpose for the drum circle-based implementation of the musical game system 100 was to create generative, non-linear music compositions from participant interaction (e.g., from user inputs 166). The musical game system 100 had show or control programming built upon two software programs or modules. One is a music composition module 114 that was Max/MSP based or built upon Max/MSP, which provides an interactive graphical dataflow programming environment for audio, video, and graphical processing. The music composition module 114 is responsible for handing the incoming data 166 from the user input devices 160 and processing it in order to trigger audio cues with audio output signals 120 and to trigger lighting cues with signals 141. The other program is a light control module 142 that allows for interactive control of lighting fixtures 154 via control signals 144 to a lighting controller 150. With regard to hardware specifications, the control system 110 that was prototyped included computers running the modules 114, 142 with AMD Phenom II X4 965 processors (for processors 112, 140) that operate at a speed of 3.41 GHz, and each of these computers had 16 GB of RAM and had a Windows 7 OS.

When a player or participant starts to play on any of the user input device or drums 160 of the system 100, the music composition module 114 first routes the incoming user input/MIDI messages 166 to one of multiple software samplers. For example, a Native Instrument Konkakt 5 player may be used, which is a VST-plugin that acts as a software sampler or sound player. During this initial processing by module 114, individual sounds loaded within the Kontakt player can be triggered by the MIDI input 166. In the prototype, the control system 110 used the Kontakt players to trigger the majority of the sounds that make up the drum circle experience via an audio output signal 120 to the audio assembly 130 for playing output sound 136 via a local speaker 132 proximate to the user input device 160. When a participant hits/taps an instrument 160, they hear a localized sound 136 of that particular instrument (differing drum tones in the prototyped example of differing drums of a drum set, which may be a sound that is a sample that is played back by the Kontakt player). In other implementations, audio files in the memory 116 may be triggered outside of the Kontakt players within the Max/MSP-based music composition module 114.

The same MIDI messages/user input 166 that are used to trigger localized instrument sounds 136 to be played by the module 114 via local speakers 132 are concurrently routed to a series of objects within the Max/MSP music composition module 114 that quantize and record in memory 116 a participant's activity on an instrument/user input device 160. The quantization of user input 166 is done in relation to a continuously cycling "heartbeat" rhythm provided by the starter music track, e.g., a rhythm provided by a drum tone, other instrument's note, or other sound that is set at 120 beats per minute (BPM) or some other tempo. In this way, the module 114 performs quantization in a manner that provides a somewhat consistent musical timing.

This quantized recording of the user's input is then routed to a sampler or Kontakt player to trigger the sounds of the appropriate response instruments. The response instrument tied to each drum 160 in the prototyped example of system 100 is a product of when that drum is "activated" after the initial triggering of song mode for the musical game system 100. For example, the instrument of the drum set 160 that triggers song mode is tied/linked by the music composition module 114 to the first response instrument. The second instrument to be played in the same drum set 160 within the current song cycle of the system 100 is tied by the module 114 to the second response instrument. This chain continues until all (e.g., one to five or more) of the instruments/drums in the drum set or at an "island" 160 are activated by a participant(s).

In operations of the music game system 100, other prerecorded instrumental or percussive elements are added to the composition or digital track depending upon the amount of participant activity at each island or drum set (user input device) 160 as well as all the drum sets/islands 160 as a whole. Song or track composition mode of operation continues until activity at all of the user input devices/islands 160 has stopped for some predefined inactivity period (e.g., for 5 to 15 seconds or the like with the prototyped system using a period of inactivity of 10 seconds as a trigger). Most of the sound cues are done in relation to timing with the background rhythm or starter music track, and, in this case, a "flag" is raised to reset to attract mode of operations for the musical game system 100 after the inactivity period (e.g., 10 seconds) is detected. However, the actual reset may not happen until the next downbeat of the starter music track or background rhythm track. The inactivity timer flag can be raised but because of participant activity before the downbeat the song mode will continue without resetting.

If the song composition or present game resets, there can be a period of time (e.g., 5 to 10 seconds or the like) where the heartbeat or rhythm provided by the starter music track discontinues or the track is not played (or beat provided) and participant input 166 does not trigger the next song composition or new game mode. After this delay period ends, the heartbeat rhythm is started again by the module 114, such as by playing the starter music track or starting a metronome function of the music composition module 114 to trigger sounds to be played 136 over the global speakers 134, and the system 100 returns to its attract participants mode of operations. Within the song composition mode of operations, the module 114 may switch from a beginning mode to a final mode. When this switch occurs, the response instruments are typically no longer triggered so no longer audible via the audio assembly 130, and the module 114 may act to play a two-measure, polyrhythmic loop (or other sound) by transmitting audio output signals 120 to the audio assembly 130 to output sound 136 via one or both of the local and global speakers 132, 134 to indicate the switch from song composition mode to a final game play mode. The overall game play or music generating experience can easily be designed to move back and forth between the song composition mode and the final mode such as depending upon the amount of use at each island or user input device 160.

In terms of lighting controls, the music composition module 114 acts to generate and send OSC messages 141 to a light control module 142 (which may be run by a processor 140 of a second computer in the control system 110), which was a dynamic lighting module in the prototype drum circle system 100. These messages 141 provide the module 142 with float values between 0 and 1 that correlate with the intensity of specific sources. Lighting effects in the system 100 may be primarily localized to the physical space or area around an active island/user input device 160 with cooperative inter-island activity creating a more expansive lighting effect through the entire area in which the system 100 is positioned. For example, the lights 154 that are positioned near a user input device 160 may be triggered in response to the user input signal data 166 and messages 141 to provide a lighting effect that is directly responsive to the participant's interaction with the user input device 160. In some embodiments, the lights 154 may also include video projectors that may have operations triggered by the output signals 144 of the light control module 142 such as to project video imagery onto set pieces or physical structures near to or visible by a participant using a particular input device 160.

Figure 2:
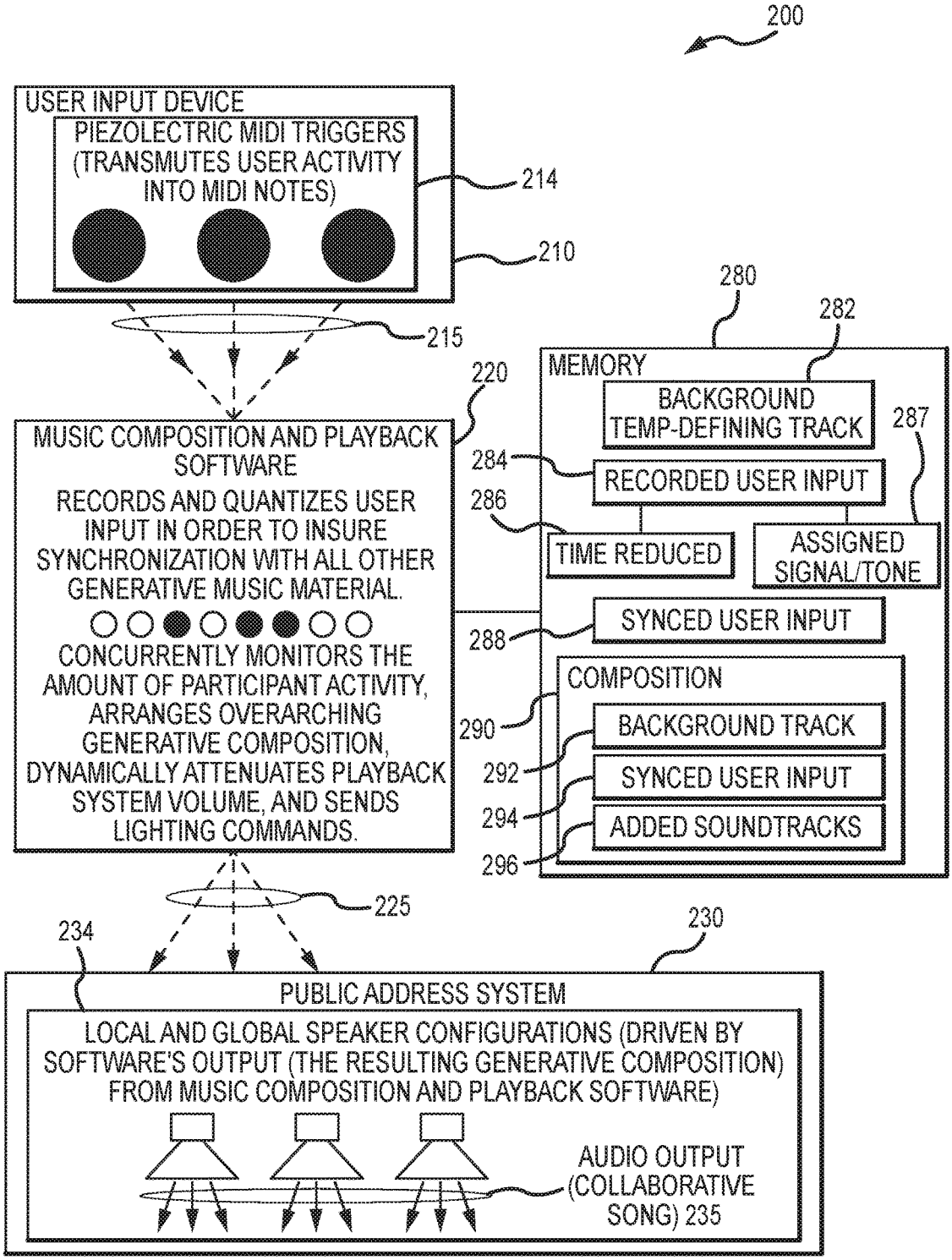
FIG. 2 is another functional block diagram of a musical game system showing more detail of composition and playback functions performed by the music composition and playback software run by the system's control hardware and software (e.g., the Max/MSP-based music composition module run on the control system of FIG. 1)

With the relatively specific example of the game system 100 of FIG. 1 understood, it may now be useful to describe the musical game system and methods of the present description in a more general implementation or at a higher level. FIG. 2 is a functional block diagram of a musical game system 200 showing more detail of composition and playback functions performed by the music composition and playback software 220 run by the system's control hardware and software (e.g., the control system of FIG. 1, with hardware not shown in detail in FIG. 2 but will be understood from FIG. 1).

As shown, the system 200 includes a user input device 210, with one device 210 shown for simplicity but a typical game system 200 will include 2 to 15 or more user devices each operable to sense human operator interactions so as to receive user input. The user input device 210 is shown to include a set of piezoelectric MIDI triggers 214, which function to transmute user activity (e.g., tapping on a drum or drum-like surface) into MIDI trigger messages or notes 215 that are communicated (in a wired or wireless manner) to the controller of the game system 200. As explained above, the system 200 typically operates to play (via global and local speakers 234 in address system 230) background rhythm such as by choosing a starter or base music track for use in generating a digital composition track.

A participant (not shown in FIG. 2) interacts, during the playing of this starter or base music track, with the user input device and such interaction (or playing of notes on an instrument such as one or more drums or the like) is detected by the triggers 214 which causes the MIDI trigger signals or notes 215 to be generated and communicated to the system controller for processing by the music composition and playback software 220 (e.g., to play the note when it is determined to be in time with the background rhythm of the starter or base track (e.g., correspond with a beat or rhythm note of the starter or base track) or to quantize the note to align its timing with the background rhythm of the starter or base track and then to play back this recorded and time-adjusted note with the rhythm notes (delayed until a next rhythm note or the like) of the starter or base track and any other notes provided by the user input device (or other user input devices)).

As shown in FIG. 2, the music composition and playback software 220 is configured to record each of the trigger signals or MIDI notes 215 from the user input device during song composition mode of operation. Further, the recorded notes are then quantized in order to insure synchronization with all other generative music material, e.g., other MIDI notes from the user input device (e.g., notes played on one drum or instrument of the user input device is quantized to sync with notes played on the other drums or instruments of the user input device or notes played by other participants via other user input devices 210). Concurrently, the software 220 monitors the amount of participant activity (e.g., is there ongoing interaction with the user input device 210 or has there been a pause greater than a predefined inactivity-defining period?) to determine when operations of the system 200 should transition out of song composition operating mode.

Further, the software 220 acts to arrange the overarching generative composition. Recorded MIDI notes also trigger melodic content that is tied to a fixed musical key/scale whose timbral diversity covers the equivalent range of a full orchestral ensemble. A chordal progression, much like the rhythmic "heartbeat," constrains the melodic content further, creating a forever looping progression of Western-based musical ideas. These progressions are also randomized, so the guest's/user's experience continues to vary over time. Ultimately, harmony, not just rhythm, becomes driven by guest/user input, both individually as well as collectively.

The system 200 includes memory or data storage devices 280, and the music composition and playback software 220 stores and retrieves the background tempo-defining track 282 (or its definition) from memory 280 for playback over the public address system 234. User input 215 is recorded as shown at 284 with a time received 286, and each user input device or trigger 214 is typically linked to a particular prerecorded/defined sound or melodic, and the sound/melodic 287 assigned to the user input 284 may also be stored in memory 280 by the software 220. The software 220 acts to synchronize the user input 284 with the background tempo-defining track 282 (e.g., by allowing in time/in sync notes to play and by time aligning any out-of-time notes with nearby or next acceptable note times as defined by the background tempo-defining track 282).

The software 220 may then create and store (or simply output as shown at 225) the generative composition 290, which may include the background track 292, synchronized user input from all user input devices 210 of the game system 200, and any additional sounds/soundtracks mixed in by the software 220 (e.g., sounds, melodic soundtracks, and so on may be added based on the number of instruments within a user device 210 are concurrently used by participants and/or based on concurrent use of two or more user input devices by participants playing or interacting with the music game system 200).

The digital composition track 290 created by the software 220 based on the notes 215 is then used to generate audio output signals 225 that are used to operate an audio playback system 230 with local and global speakers 234 to output the sounds/music (or audio output) 235 that can be heard by the participants and non-participants in the space containing the user input device(s) 210. As discussed with reference to FIG. 1, the software 220 may also function to generate and send lighting commands to a lighting system based on the collaborative composition (e.g., in response to the MIDI notes 215 after they are recorded and quantized to provide synchronization with each other and/or with the background rhythm of the starter/base track).

The music composition and playback software 220 also may act to dynamically attenuate volume of speakers 234 in the playback system or public address system 230. For example, the MIDI notes 215 may be used to trigger response instrument notes/sounds at a first volume at the local speaker(s) 234 proximate to the user input device 210 while the same notes/sounds are included in the collaborative composition at a lower volume for playback over the global speakers. This allows the participant to be able to hear their contribution to the collaborative song/composition locally (as would be the case with a conventional instrument) while others hear that participant's input in the playback of the collaborative song but at a lower level (as also would be the case with a conventional instrument that is spaced apart from a listener). The dynamic attenuation may also include increasing local speaker volume levels when a first relatively small number of user input devices 210 are being operated by participants and then decreasing the local speaker volume levels when a second relatively large number of user input devices 210 are being concurrently operated by participants to retain the overall sound levels (which can be set at some predefined decibel level) within a relatively constant range.

Figure 3:
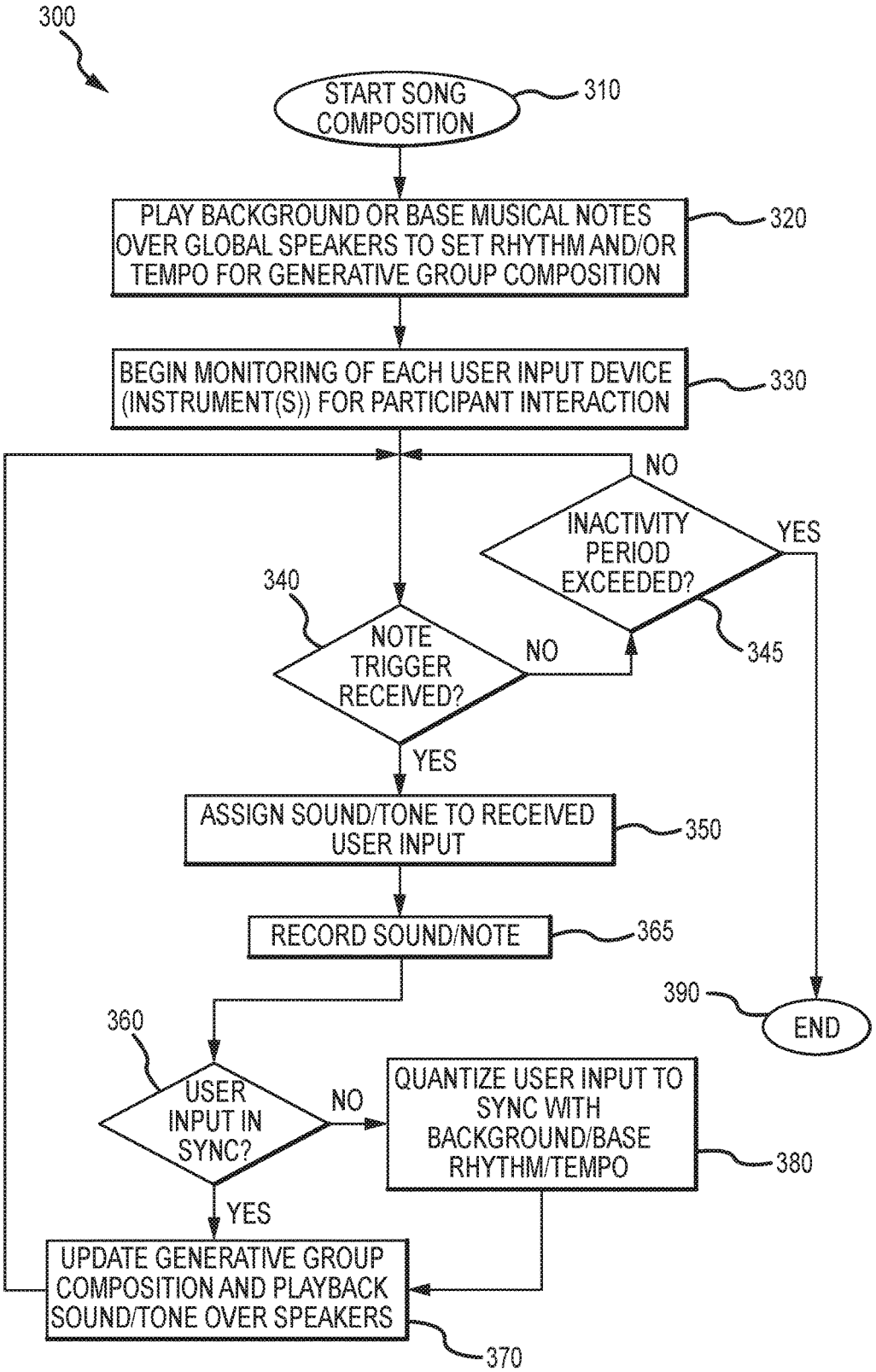
FIG. 3 is a flow diagram for a collaborative song composition and playback method of the present description such as may be implemented by operation of the musical game systems of FIGS. 1 and 2.

FIG. 3 is a flow diagram for a collaborative song composition and playback method 300 of the present description such as may be implemented by operation of the musical game systems of FIGS. 1 and 2 (e.g., by the software/programs/modules 114 and 220). The method 300 starts at 310 such as with loading and running music composition software on a computer used as part of a music game system. Step 310 may also include selecting a background or base musical track for use in generating a generative group composition or by selecting a rhythm and/or tempo for the generative group composition and choosing one or more sounds to output over speakers to set and audibly cue this rhythm and/or tempo to human participants of the method 300.

The method 300 continues at 320 with playing the background or base musical notes over global speakers in a space containing a plurality of user input devices (e.g., drums or drum sets, keyboards, touchscreens for displaying musical instruments, and the like). This output can be thought of as providing the metronome that defines the tempo that participants are trying to comply with when interacting with each user input device to make music and create a generative group composition. The background musical notes may take many forms such as beats of a snare or bass drum or a bass guitar and may be provided at the beginning of each measure of the generative group composition being created in the method 300.

At step 330, the method 300 continues with the control system acting to monitor each user input device in the music game space for interaction or use by a participant. For example, each drum in a drum set may include a piezoelectric MIDI trigger or other input detection element, and the control system including the music composition software may have a communication link with each of these triggers to allow it to receive a signal indicating a trigger or MIDI note (or "note trigger") based on detected participant activity. At step 340, the music composition software acts to determine whether or not a note trigger has been received. If not, the method continues at 345 with a determination of whether or not an inactivity period has been exceeded (e.g., no user input has been received for a period of 10 or 15 seconds or the like). If this time period has been exceeded, the method 300 may end at 390 (or the game system may return to an "attract" operating mode (e.g., operating lights to direct participants toward the user input devices/instruments, playing a soundtrack of music such as a previously generated group composition, or the like)).

If at 340 a note trigger (or MIDI note) is determined as being received, the method 300 continues at 350 with the music composition software assigning a digital (or previously recorded) sound/tone to the received MIDI note/trigger. This may involve determining which user input has been operated by a participant or which portion of the user input device (e.g., a particular drum within a drum set, a key on a keyboard input device, and so on) has been interacted with or "played" by the participant, and then the sound/tone linked to that input device or portion of the input device can be retrieved or identified. At step 365, the sound/tone from step 350 is recorded in memory along with its receipt time.

At step 360, the method 300 involves determining whether or not the user input/trigger is in sync with the background rhythm or tempo set in step 320. For example, the background or base musical track may define when notes can be played by a participant (user input be received), and the synchronization determination may involve determining if the user input was received at one of these acceptable times. If determined to be properly synchronized, the method 300 continues at 370 with updating the generative group composition and playing the group composition including the sound/tone associated with the MIDI trigger/user input over the global speakers of the game system and, typically, playing back the sound/tone over a speaker that is local to the user input device from which the MIDI trigger/user input originated.

If at 360 the user input received is determined to be out of time or not synchronized with the rhythm or tempo set by the background or base music track, the method 300 continues at 380 with quantizing the user input. Quantization may involve time aligning the received user input with the background or base music track such as to a next proper time for a note to be played in the generative group composition. The method 300 then continues with step 370 by updating the generative group composition to include the sound/tone associated with the user input/MIDI trigger at its newly assigned and synchronized time. The generative group composition is played over the global speakers of the game system and the sound/tone is played back at a speaker local to the user input device that provided the MIDI trigger/user input. The method 300 then continues at 340 to await a next MIDI or note trigger from a user input device in the music game system.

Figure 4:
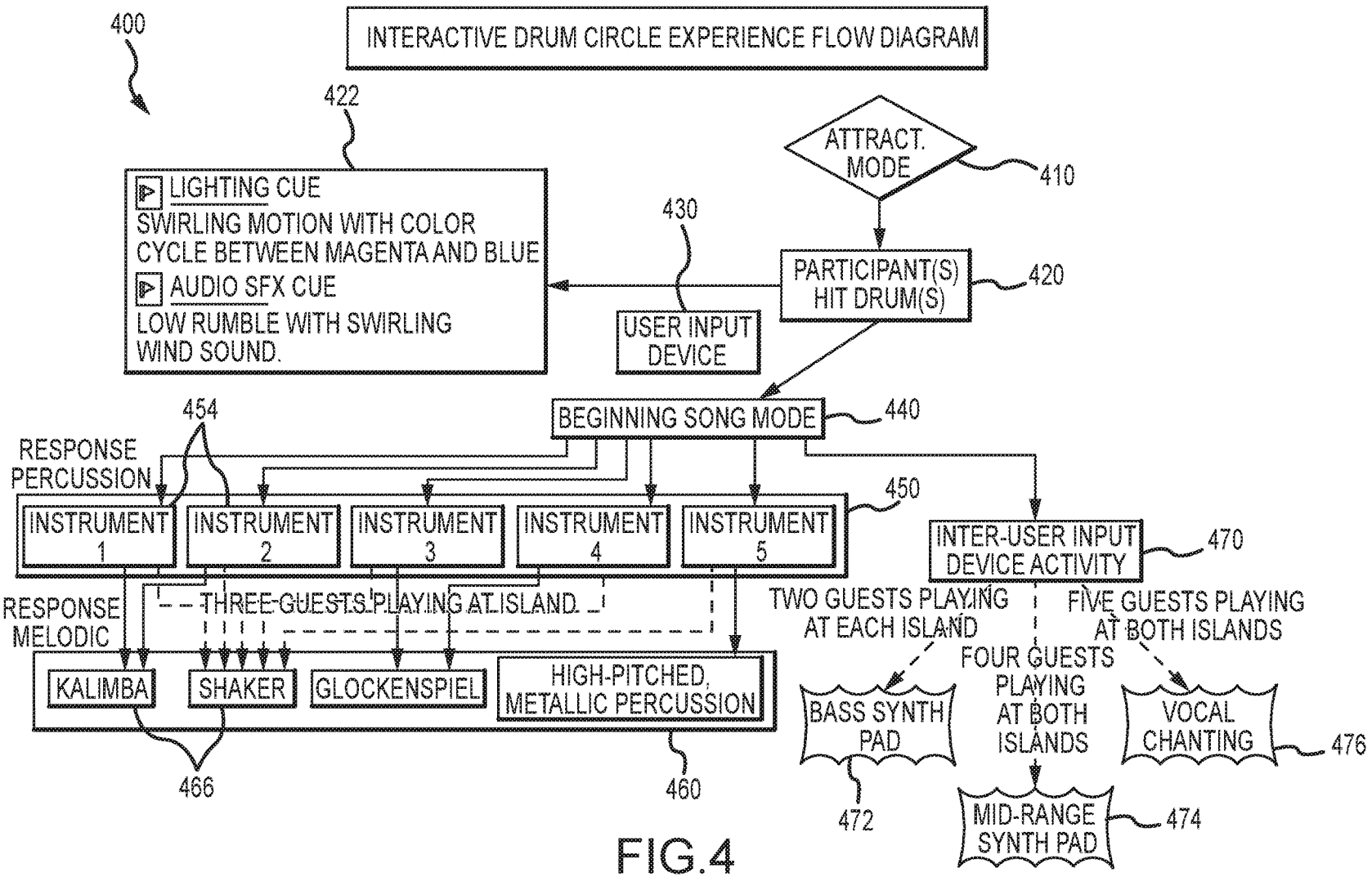
FIG. 4 is a flow diagram of an interactive drum circle experience that is provided by operation of an embodiment of a music game system of the present description such as the system of FIG. 1 or the system of FIG. 2.

FIG. 4 is a flow diagram of an interactive drum circle experience 400 that is provided by operation of an embodiment of a music game system of the present description such as the system 100 of FIG. 1 or the system 200 of FIG. 2. This is an example of a gaming or music generation experience/method 400 of a particular embodiment in which user input devices were provided that each were an island or set of drums/percussion instruments that can be played by a participant during a song mode of operation of a music game system. Only one user input device 430 is shown but the game system would include two, three, or more (e.g., up to 15 or more user input devices).

As shown, the operation of game system or the experience may start with the game system operating in an attract mode 410. When in the attract mode, the game system may operate so that no sounds are being generated as there are no participants interacting with the user input devices. The game system may operate a lighting system to try to draw potential participants in the game space to interact with each of the user input devices. For example, the attract mode may involve use of colored, pulsing lighting effects that flow through LED lighting strips or other light sources that are local to each user input device 430 of the music game system.

At 420, a participant has been drawn to the user input device 430 and has hit one of the input elements or "drums". In response, the experience 400 may include at 422 lighting cues and audio effect cues being generated by the game system. For example, the lighting system may be operated in a predefined manner when each user input device is being used such as with flashing (e.g., from a first color to a second color or the like) and/or with a swirling light pattern. The audio cues may involve the game system operating to retrieve from memory and playback over the global or local speakers a predefined soundtrack, which may be themed to link with the group composition to be created and/or to the "land" or location of the space in which the interactive drum circle experience 400 is provided. For example, a prototyped experience 400 had a jungle or tropical island theme and the audio cue provided at 422 was a low rumble with swirling wind sounds.

Particularly, the experience 400 involves after the participant (or participants as each user input device may be operated by two or more human operators) activates one of the drums/instruments 454 at 420 causing the music game system to enter the song mode of operation as shown at 440. As shown, the user input device 430 includes a drum set 450 with five drums as input elements 454. These provide the participant with response percussion to interact with during the experience 400, and each instrument/drum 454 is associated with one (or more) sounds/tones 466 in a set of pre-recorded (or predefined) response melodics such as a kalimba sound, a shaker sound, a glockenspiel sound, and a metallic percussion sound (e.g., a high-pitched bell, a cymbal, a gong, and the like) such that the drums/instruments 454 behave or function as a small, high-pitched percussion instrument (e.g., a conga), a high-pitched wood percussion instrument (e.g., a woodblock), a large, low-pitched percussion instrument (e.g., a djembe), a mid-range drum, and a lower range or bass drum.

When a participant hits/activates one of the instruments/drums 454 of the drum set 450, the assigned sound/tone 466 from the melodic set 460 is recorded and played over a speaker local to the user input device 430 and also in a time synchronized manner with the other material of the generative group composition created during the drum circle experience 400. In some experience implementations 400, when in song mode 440, the music game system records every activation or user input provided via each instrument/drum 454 of each user input device 430 upon detection of an interaction (e.g., a MIDI trigger is received). The recording is then quantized to the current tempo of the backing or base track being played by the music game system over the global speakers in the experience space and then replayed as the assigned melodic (which may be a pre-recorded sound/tone or one that is predefined and generated digitally at the time of playback of the generative group composition over the game system speakers).

The experience 400 may also involve the music game system operating to select additional prerecorded soundtracks or sounds to include for playback in the group composition. For example, a sound or soundtrack may be selected from a set of sounds/soundtracks based on the number of instruments/drums being actively played in each user input device. In other examples, a sound or soundtrack may be selected and played as part of the group composition when two or more user input devices are in concurrent use as shown at 470 with one or more of the sounds 472, 474, and 476 (e.g., a bass synthesizer track, a mid-range synthesizer track, a vocal chanting/singing track, and the like) being played over the global speakers of the game system when two, three, or more of the user input devices are in concurrent use.

In this way, the group composition is a composite or mixing of the background or base rhythm track, sound/tones associated with each of the instruments/drums 454 of each user input device that is being actively played (with these sound/tones being synched by the control system with the background or base rhythm-defining track), and additional sound/soundtracks chosen based on measured amounts of participant interactivity with the user input devices (e.g., a differing number and/or a differing sound/soundtrack based on the number of instruments within a user input device and/or based on the number of user input devices being used by participants).

As shown, user inputs (e.g., drum hits or the like) are tracked to a background track (e.g., a repeating metronome or the like). The music composition software acts to determine whether each of the user inputs is in time or out of time relative to the tempo of the background track (which defines the timing of acceptable user inputs/note triggers). The software then acts to let the in time user inputs to be "played" (e.g., a speaker local to the user input device may be used to playback a sound/melodic associated with that user input device (or instrument of the user input device) or the sound/melodic may be added to the generative composition track for playback without time alignment). If the user input is mistimed or out of time relative to the acceptable timing of notes based on the background track, the software may act to perform quantization so as to time align the user input with the tempo of the background track, and the sound will be played back at this newly assigned time (e.g., to coincide with a next beat or the like in the background track).

The music composition and playback software may be configured to add melodic outputs to the generative composition such as to add a melodic component when game play achieves certain levels such as higher levels of use of a user input device (e.g., two or more of a plurality of instruments/input elements of a user input device) or of user input devices (e.g., two or more user input devices in different locations in the game space may be concurrently used).

The software further may be configured to provide dynamic volume control through selective control of the audio system. This may include reducing local speaker volumes as the number of participants playing within the game system increases (volume is decreased in a manner that is inversely proportional to the number of participant or number of user input devices/instruments being played or decrease to predefined levels at predefined numbers of participants/used input devices).

The software also provides dynamic panning in that the software may choose speakers for playback of sounds/tones/melodics based on which user input or instrument was used to provide a particular input, e.g., use speaker local to a user input device or even instrument within that user input device to playback a sound/tone/melodic associated with that user input device/instrument as well as playing that sound/tone/melodic in a time-synchronized manner over the global speakers along with other generative materials from other user input devices.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The examples of user input devices included drums, keyboards, and other similar instrument or instrument-based input elements. In other cases, the user input devices may include motion sensors such that the participant may simply perform one or several movements to provide their input (e.g., to trigger a sound or note). For example, the user input device may be configured to recognize a hand gesture or motion, a dance step or move such as by including IR tracking or similar technologies. Piezoelectric MIDI triggers were discussed, but the user input device may also include nearly any touch-sensitive surface to detect a user interaction and provide a responsive note trigger/user input signal to cause a sound/melodic to be played back or inserted into the generative composition track. In some embodiments, the user input signal may include vocal inputs, and the composition software may be configured to synchronize the playback of this vocal input with the background rhythm without modulation or with modulation (e.g., to cause the vocal input to be quantized and/or in tune with the background music and/or with other sounds/melodics of the composition and/or with other vocal inputs of other participants in the game system).

We claim:

1. A method of providing a musical game, comprising:

first operating an audio output assembly to output sound associated with a background rhythm track defining timing of notes for a group collaborative composition;

during the first operating, sensing a plurality of interactions with a plurality of user input devices;

in response to the sensing, generating a note trigger signal for each of the user input devices;

with a processor running a music composition and playback module, processing each of the note trigger signals to select a playback sound and to determine, in relation to the background rhythm track, whether the note trigger signals are synchronized with the timing of the notes or unsynchronized with the timing of the notes;

with the music composition and playback module, quantizing each of the unsynchronized note trigger signals individually using the timing of the notes to time align the unsynchronized note trigger signals with the background rhythm track; and with the music composition and playback module, second operating the audio output assembly to play the group collaborative composition via the audio output assembly including outputting the playback sounds for the synchronized note trigger signals and outputting the playback sounds for the time aligned note trigger signals, wherein the quantizing comprises aligning timing of playback of each of the unsynchronized note trigger signals with one of the notes of the group collaborative composition.

2. The method of claim 1, wherein the audio output assembly includes a speaker local to each of the user input devices and wherein the playing of the group collaborative composition comprises playing the playback sounds associated with each of the note trigger signals at one of the speakers local to the user input device associated with the generating of the note trigger signal.

3. The method of claim 2, wherein the audio output assembly includes a plurality of global speakers operated during the playing of the group collaborative composition to play all of the playback sounds.

4. The method of claim 2, wherein the playing of the group collaborative composition comprises dynamically adjusting volume levels of the speakers local to the user input devices based on a number of the user input devices being concurrently operated with the plurality of the interactions.

5. The method of claim 1, further comprising selecting additive melodic tracks based on a number of or locations of the user input devices operated by the plurality of the interactions and wherein the playing of the group collaborative composition includes playing the additive melodic tracks with the playback sounds and synchronized with the timing of the notes.

6. The method of claim 1, wherein the user input devices each comprises at least one contact surface and a piezoelectric MIDI trigger associated with the contact surface for performing the generating of the note trigger signal.

7. A music game system, comprising:

a controller with a processor executing code to provide a music composition module;

an audio system with a set of global speakers and a set of local speakers; and a plurality of user input devices adapted to generate trigger signals in response to user interactions, wherein the music composition module transmits first audio output signals to the audio system to play a background rhythm over at least the global speakers, wherein the music composition module processes the trigger signals and, in response, transmits second audio output signals to play a playback sound for each of the trigger signals, wherein the processing of the trigger signals includes identifying a subset of the trigger signals as being out-of-time relative to the background rhythm and, in response, synchronizing the subset of the trigger signals with the background rhythm for inclusion in the second audio output signals, wherein the second audio output signals are configured to play one of the playback sounds at one of the local speakers operated to generate a corresponding one of the trigger signals, and wherein a volume level of each of the local speakers is adjusted by the music composition module during the playing of the playback sounds based on a number of the user input devices generating the trigger signals.

8. The system of claim 7, wherein the synchronizing includes time aligning each of the trigger signals in the subset of the trigger signals with at least one note beat in the background rhythm.

9. The system of claim 7, wherein the user input devices each includes a MIDI trigger for generating the trigger signals.

10. The system of claim 7, wherein each of the user input devices comprises a set of instrument elements each having a piezoelectric switch generating the trigger signals and wherein one of the playback sounds is assigned to each of the instrument elements by the music composition module.

11. A music game system, comprising:

a controller with a processor executing code to provide a music composition module;

an audio system with a set of global speakers and a set of local speakers;

a plurality of user input devices adapted to generate trigger signals in response to user interactions, wherein the music composition module transmits first audio output signals to the audio system to play a background rhythm over at least the global speakers, wherein the music composition module processes the trigger signals and, in response, transmits second audio output signals to play a playback sound for each of the trigger signals, and wherein the processing of the trigger signals includes identifying a subset of the trigger signals as being out-of-time relative to the background rhythm and, in response, synchronizing the subset of the trigger signals with the background rhythm for inclusion in the second audio output signals; and memory storing a plurality of additive sound tracks, wherein the music composition module further acts to select one or more of the additive sound tracks based on a number of or location of the user input devices providing the trigger signals and wherein the second audio output signals include the selected one or more of the additive sound tracks time synchronized with the background rhythm track.

12. An apparatus for facilitating rhythm-based group composition of music, comprising:

a controller;

an audio system with a plurality of speakers; and a plurality of user input devices each generating trigger signals in response to a predefined user activity, wherein the music composition module transmits first audio output signals to the audio system to play a background rhythm over the speakers, wherein the controller processes the trigger signals and, in response, transmits second audio output signals to play a sound assigned to each of the trigger signals, wherein the processing of the trigger signals includes quantizing the trigger signals to provide time alignment of playing of the sounds with the background rhythm, and wherein the quantizing include time aligning each of the trigger signals, which is identified by the controller as being out-of-time relative with the background rhythm, with at least one note beat in the background rhythm.

13. The system of claim 12, wherein the second audio output signals are configured to play one of the playback sounds at one of the speakers proximate to one of the user input devices operated to generate a corresponding one of the trigger signals.

14. The system of claim 13, wherein a volume level of each of the speakers proximate to one of the user input devices is adjusted by the music composition module during the playing of the sounds based on a number of the user input devices generating the trigger signals.

15. The system of claim 12, further comprising memory storing a plurality of additive sound tracks, wherein the controller further acts to select one or more of the additive sound tracks based on a number of or location of the user input devices providing the trigger signals and wherein the second audio output signals include the selected one or more of the additive sound tracks time synchronized with the background rhythm track.

16. The system of claim 12, wherein each of the user input devices comprises a set of instrument elements each having a piezoelectric MIDI trigger generating the trigger signals and wherein one of the sounds is assigned to each of the instrument elements by the music composition module.

* * * * *